United States Patent [19]

Gardner et al.

[11] 4,097,281

[45] Jun. 27, 1978

[54] HEAT DEVELOPABLE PHOTOGRAPHIC MATERIAL AND PROCESS COMPRISING TRANSITION METAL CARBONYL COMPOUNDS

[75] Inventors: Sylvia Alice Gardner, Rochester; Mark Lelental, Penfield, both of N.Y.

[73] Assignee: Eastman Kodak Company, Rochester, N.Y.

[21] Appl. No.: 842,836

[22] Filed: Oct. 17, 1977

[51] Int. Cl.[2] ..... G03C 5/24; G03C 1/00

[52] U.S. Cl. ..... 96/48 HD; 96/88; 96/49; 96/92; 96/93

[58] Field of Search ..... 96/48 HD, 88, 48 PD, 96/114.1, 49, 92, 93; 106/1.22

[56] References Cited

U.S. PATENT DOCUMENTS

| | | | |
|---|---|---|---|
| 3,152,903 | 10/1964 | Shepard et al. | 96/48 PD |
| 3,445,230 | 5/1969 | Francis | 96/88 |
| 3,765,883 | 10/1973 | Endo et al. | 96/93 |

FOREIGN PATENT DOCUMENTS

| | | | |
|---|---|---|---|
| 135,540 | 11/1976 | Japan | 96/88 |
| 1,405,628 | 9/1975 | United Kingdom | 96/48 HD |
| 1,463,816 | 2/1977 | United Kingdom | 96/115 R |

*Primary Examiner*—Won H. Louie, Jr.
*Attorney, Agent, or Firm*—Richard E. Knapp

[57] ABSTRACT

A heat developable, photographic material comprising, in reactive association, (a) a photosensitive, transition metal carbonyl compound, (b) an oxidation-reduction image-forming combination comprising (i) a tellurium (II) or (IV) compound as an oxidizing agent, with (ii) a reducing agent, and (c) a binder can provide an improved non-silver image. After imagewise exposure of the heat developable material, an image can be developed by merely heating the material.

33 Claims, No Drawings

HEAT DEVELOPABLE PHOTOGRAPHIC MATERIAL AND PROCESS COMPRISING TRANSITION METAL CARBONYL COMPOUNDS

BACKGROUND OF THE INVENTION

1. Field of the Invention

This invention relates to heat developable, photographic materials and processes for developing an image employing an image-forming combination comprising a photosensitive, transition metal carbonyl compound with a certain oxidation-reduction image-forming combination. In one of its aspects it relates to a heat developable, photographic element comprising such a metal carbonyl compound with the described oxidation-reduction image-forming combination. Another aspect of the invention relates to such a heat developable, photographic composition comprising the described image-forming combination. A further aspect of the invention relates to a process of developing an image in an exposed, heat developable, photographic element as described.

2. Description of the State of the Art

It is known to provide an image with an imaging material by what has been described as dry processing with heat. These imaging materials are sometimes described as heat developable, photographic materials or photothermographic materials. Such heat developable photographic materials, after imagewise exposure, can be heated to provide a developed image in the absence of processing solutions or baths.

It has been desirable for economical as well as other purposes to provide reduced silver concentrations in heat developable, photographic materials. Attempts have been made in the past to provide this desired reduced silver concentration. For example, U.S. Pat. No. 3,152,903 of Shepard et al, issued Oct. 13, 1964 describes a dry processable imaging material containing a non-silver photosensitive component. It is indicated that the image-forming composition can comprise a latent, irreversible, oxidation-reduction reaction composition which is capable of initiation by electron transfer from a non-silver photocatalyst. The photocatalyst can be, for example, zinc oxide or titanium dioxide. A disadvantage of the imaging material described is that the image formation is not carried out using amplification as in many heat developable, silver photographic materials. This provides the necessity for undesirable high concentrations of non-silver materials.

A high gain amplification step is an important factor in heat developable, photographic materials having improved photographic speed. In such processes and materials a catalyst is in most cases formed by imagewise exposure of the photosensitive material, especially those photosensitive materials based on photosensitive silver halide. The resulting invisible or latent image formed is then useful as a catalyst for the reduction of a material in a high oxidation state to form a visible image in a low oxidation state. In silver halide photographic materials, for example, exposure of photographic silver halide to light results in formation of silver nuclei which then catalyze the further reduction of silver halide to silver in the presence of a suitable reducing agent.

It has also been known to produce tellurium images in tellurium imaging materials. For example, tellurium images can be produced by disproportionation of tellurium dihalides. The images are formed in the presence of a processing liquid which aids in the disproportionation reaction. Some unexposed tellurium dihalides, however, are dark in color causing poor image discrimination. Further, the tellurium dihalides are typically unstable in air and undergo light induced decomposition only when moistened with a suitable organic solvent. For these reasons, the tellurium dihalides are disadvantageous in imaging materials designed for processing with heat.

It is also known to use other tellurium compounds in imaging materials. For example, British Specification No. 1,405,628 (corresponding to Belgian Pat. No. 786,235) and copending U.S. application Ser. No. 703,477 of Lelental and Gysling, filed July 8, 1976 describe such materials. While tellurium compounds are useful in imaging materials, such as photothermographic materials, none of such imaging materials have used a photosensitive transition metal carbonyl compound as the photosensitive component to yield a high density, high resolution tellurium metal image in a heat developable, photographic material.

Photocopying materials are known that use photosensitive metal carbonyls as a photosensitive component. None of these materials involve a heat developable, photographic material or such a material comprising a tellurium compound for imaging purposes.

There has been a continuing need to provide improved, heat developable, photographic elements, compositions and processes which enable reduction or elimination of silver in the described materials. This continuing need has been especially important for non-silver, heat developable materials which enable amplification of a non-silver, nuclei image with tellurium without the need for processing solutions or baths.

SUMMARY OF THE INVENTION

It has been found according to the invention that an image can be provided in a heat developable, photographic material comprising, in reactive association, (a) a photosensitive, transition metal carbonyl compound, (b) an oxidation-reduction image-forming combination comprising: (i) an organotellurium (II) or (IV) compound as an oxidizing agent, with (ii) a reducing agent, and (c) a binder.

After imagewise exposure of such a photographic material, the resulting image can be developed by heating the material to a temperature within the range of about 80 to about 250° C until the image is developed.

The described materials and process enable formation of a developed image in the absence of photosensitive silver halide or other silver compounds. They also enable elimination of processing solutions and baths.

DETAILED DESCRIPTION OF THE INVENTION

One embodiment of the invention, as described, is a heat developable, photographic element comprising a support having thereon, in reactive association, the above described components (a), (b) and (c).

A variety of photosensitive transition metal carbonyl compounds is useful in the described heat developable photographic materials. An especially useful photosensitive transition metal carbonyl compound is represented by the formula:

$$RM(CO)_nX_m$$

wherein R is an arene, such as benzene, tetralin and naphthalene; a substituted arene, such as toluene, xylene, mesitylene, anisole, aniline, p-toluidine and dimethylaniline; a cyclopentadienyl ligand or an organonitrile ligand, such as benzonitrile and acetonitrile; M is preferably Cr, Mo or Fe; X is alkyl, such as alkyl containing 1 to 6 carbon atoms, for example, methyl, ethyl, propyl and butyl; chlorine, bromine or iodine; *n* is 3 to 5 and, *m* is 0 or 1. M is preferably chromium or molybdenum and also includes other transition elements in groups Vb, VIb, VIIb and VIII of the Periodic Table which can be useful in certain imaging materials. Such transition elements include, for example, manganese, tungsten and iron. Other useful transition metal carbonyl compounds are described in U.K. Specification No. 1,463,816 published Feb. 9, 1977, the description of which is incorporated herein by reference. An especially useful photosensitive transition metal carbonyl compound is an arene chromiumtricarbonyl compound, such as tetralin chromiumtricarbonyl or mesitylene chromiumtricarbonyl.

The optimum concentration of the described photosensitive transition metal carbonyl compound will depend upon such factors as the particular organotellurium compound, the particular reducing agent, the desired image, processing conditions and the like. A typically useful concentration of photosensitive transition metal carbonyl compound is within the range of about 0.1 mg/ft$^2$ to about 500 mg/ft$^2$ (corresponding to about 0.01 mg/dcm$^2$ to about 54 mg/dcm$^2$. When an arene trichromiumcarbonyl compound is used, an especially useful concentration is within the range of about 0.2 mg/ft$^2$ to about 300 mg/ft$^2$.

A variety of tellurium (II) and (IV) compounds is useful in the described imaging materials as oxidizing agents. Selection of an optimum tellurium (II) or (IV) compound or combination of such compounds will depend upon such factors as the particular reducing agent, the particular transition metal carbonyl compound, desired image, processing conditions, other components of the imaging material and the like. Useful tellurium (II) or (IV) compounds include, for example, coordination complexes of tellurium (II) or (IV), typically coordination complexes with two univalent bidentate sulfur-containing ligands. The described complexes of tellurium (II) have a coordination number of four. The complexes are characterized by having at least one of the coordinating ligands coordinate to the tellurium through a sulfur atom. However, complexes as described may have any number of tellurium coordination positions occupied by the sulfur atom of a suitable sulfur-containing ligand. The tellurium can be coordinated with a monodentate, bidentate or tridentate sulfur-containing ligand or with combinations of these ligands. The tellurium can also be coordinated with a tetradentate sulfur ligand. The sulfur-containing ligands can be neutral or anionic. Useful tellurium (II) and (IV) compounds as oxidizing agents are described, for example, in copending U.S. application Ser. No. 703,477 of Lelental and Gysling, filed July 8, 1976, the disclosure of which is incorporated herein by reference.

Useful monodentate sulfur ligands in the described tellurium compounds include, for instance, neutral Lewis base ligands such as thiourea; substituted thiourea, such as ethylene thiourea, N,N'-diphenyl thiourea, 1-(1-naphthyl)-2-thiourea, tetramethyl thiourea; 1-methyl-2-thiourea; 1-butyl-2-thiourea; and the like.

Useful bidentate sulfur ligands include anionic bidentate ligands, such as dithiocarbamates represented by the formula ($R^1{}_2NCS_2$) wherein $R^1$ is aryl, such as aryl containing 6 to 12 carbon atoms including phenyl and benzyl, alkyl containing 1 to 6 carbon atoms, including methyl, ethyl, propyl, isobutyl, cyclohexyl and the like; xanthates represented by the formula ($R^2OCS_2$) wherein $R^2$ is alkyl containing 1 to 20 carbon atoms, such as methyl, ethyl, propyl, isopropyl, cyclohexyl and the like; dithiophosphates represented by the formula ($(R^2O)_2PS_2$); dithiophosphinates represented by the formula ($R^2{}_2PS_2$); dithiocarboxylates such as those represented by the formula ($R^3CS_2$) wherein $R^3$ is aryl, such as phenyl, naphthyl and substituted phenyl and naphthyl; dithioalkanes represented by the formula $R^4$—S—$(CH_2)$—$_n$S—$R^5$ wherein *n* is an integer from 1 to 6 and $R^4$ and $R^5$ are the same or different and are aryl such as phenyl, naphthyl, substituted phenyl and the like.

Suitable tridentate sulfur-containing ligands include trithioalkanes represented by the formula $R^4$—S—$(CH_2)$—$_n$S—$(CH_2)$—$_n$S—$R^5$ wherein $R^4$, $R^5$ and *n* are as described.

Useful tetradentate sulfur ligands include tetrathioalkanes represented by the formula $R^4$—S—$(CH_2)$—$_n$S—$(CH_2)$—$_n$S—$(CH_2)$—$_n$S—$R^5$ wherein $R^4$, $R^5$ and *n* are as defined. Macrocyclic ligands are also useful, such as the macrocyclic ligands described in the reference: K. Travis and D. H. Busch, *Inorganic Chemistry,* Vol. 13, beginning at page 2591 (1974).

Provided that at least one of the coordination positions of the tellurium (II) complex is occupied by a sulfur-containing ligand as described, the remaining positions, if any, can be occupied by either neutral or anionic ligands. Depending upon the combination of sulfur-containing ligands, neutral ligands and anionic ligands for the tellurium complex may have a valence of from 0 to 2. In instances in which a complex has a valence other than 0, a neutral salt of the complex can also be useful. In instances in which the complex itself is neutral, it can be used alone.

The term tellurium (II) or (IV) "compound" and the term "complex" as used herein are intended to include any type of bonding or complexing mechanism which enables the resulting material to provide oxidizing agent properties and the described oxidation-reduction image-forming combination. In some instances the exact bonding of the described tellurium (II) or (IV) compounds and complexes is not fully understood. Accordingly, the terms compound and complex are intended to include salts and other forms of bonding which enable the desired oxidation-reduction image-forming combination. The terms tellurium compound and complex, as described, also are intended to include neutral complexes or salts of non-neutral complexes.

A wide variety of ligands known in the art can be useful. However, the ligand or ligands must be compatible with the described sulfur ligand. Typical neutral ligands useful herein are within the group Va or VIa donor atoms. Examples of these ligands are $P(C_6H_5)_3$; 1,10-phenanthroline; 2,2'-bipyridine and the like. Typical anionic ligands include halides such as chloro, bromo and iodo; ions which function like halides such as (NCO), (NCS), (NCSe), (NCTe) and the like, cyanoborohydride (i.e., $BH_3CN$); hydroborate anions such as ($BH_4$), ($B_3H_8$), ($B_9H_{14}$) and the like; carboxylates such as ($CH_3CO_2$), ($CF_3CO_2$) and the like; ($NO_2$); ($NO_3$); ($SO_4$); ($BF_4$); $B(C_6H_5)_4$; ($ClO_4$); ($PF_6$) and the like.

The tellurium (II) compound can be prepared by sustitution reactions starting with a suitable inorganic tellurium (II) compound such as sodium tellurium thiosulfate and the like. The inorganic compound can be dissolved in a warm acid, such as hydrochloric or hydrobromic acid, and a warm aqueous solution of an alkaline metal or ammonium salt of the desired bidentate anionic ligand is added. The desired tellurium compound readily precipitates and can be recovered using separation methods known in the art.

Tellurium compounds or complexes wherein the tellurium (II) is complexed with two bidentate sulfur-containing ligands are represented by the formula: $[Te(BL^1)(BL^2)]$ wherein $BL^1$ and $BL^2$ are the same or different and represent bidentate sulfur-containing ligands as described. Typical tellurium (II) compounds which are useful include, for example:

$Te(S_2COC_2H_5)_2$,
$Te(S_2P(C_6H_{11})_2)_2$,
$Te(S_2COC_6H_{13})_2$,
$Te(S_2COC_5H_{11})_2$,
$Te(S_2COCH(CH_3)_2)_2$, and
$Te(S_2COC_{18}H_{37})_2$.

Another useful group of tellurium compounds includes compounds wherein the tellurium (II) is complexed with two monodentate ligands which are neutral Lewis bases and contain sulfur donor atoms and with two ligands which are univalent anionic ligands. These compounds or complexes can be prepared by methods known in the art such as by ligand reduction of a tellurium (IV) compound using the appropriate sulfur ligand as described. Tellurium compounds of this group can be represented by the formula: $[Te(NML^1)(NML^2)(UAL^1)(UAL^2)]$ wherein $NML^1$ and $NML^2$ are the same or different and represent neutral Lewis base monodentate ligands containing sulfur donor atoms as described above; and $UAL^1$ and $UAL^2$ are the same or different and represent univalent anionic ligands also as described above. Typical tellurium compounds within this group include, for example:

$[Te(thiourea)_2(Cl)_2]$,
$[Te(thiourea)_2(SCN)_2]$,
$[Te(1\text{-allyl-2-thiourea})_2(Cl)_2]$, and
$[Te(1,3\text{-diallyl-2-thiourea})_2(Cl)_2]$.

A third useful group of tellurium compounds includes compounds wherein the tellurium (II) is coordinated to four monodentate ligands which are neutral Lewis bases and contain sulfur donor atoms. All four ligands can be the same; or there can be two of one ligand and two of another ligand coordinated with the tellurium (II). These compounds have a valence of +2 and form salts with common anions. These compounds can be prepared by the same methods as those for the second group described using a large excess of the desired sulfur ligand. Tellurium compounds of this third group can be represented by the formula:

$[Te(NML^1)_2(NML^2)_2](UAL^1)(UAL^2)$ wherein $NML^1$, $NML^2$, $UAL^1$ and $UAL^2$ are as described. Typical tellurium compounds within this group include, for example:

$[Te(ethylenethiourea)_4]Cl_2$ and
$[Te(1\text{-}(1\text{-naphthyl})\text{-2-thiourea})_4]Cl_2$.

Tellurium compounds as oxidizing agents to be most useful should be relatively pale-colored or colorless and capable of forming images of good definition due to the lack of color.

Coordination complexes of tellurium (IV), as described, are useful oxidizing agents in the imaging elements according to the invention. Examples of suitable tellurium (IV) coordination complexes include penta and hexahalo, such as chloro, bromo and iodo, complexes, including $[TeX_5]^{1-}$ and $[TeX_6]^{2-}$, wherein X is chlorine, bromine or iodine, and various mixed compexes, such as $[TeCl_4Br]^{2-}$ and the like. The counter cation of such anionic complexes can be an alkali or alkaline earth metal ion, a quaternary ammonium ion, $[N(P(C_6H_5)_3)_2]^+$ and other organometallic cations that do not adversely affect the desired imaging. Such halo complexes are described, for instance, in G. A. Ozin and A. Vander Voet, J. Mol. Struct., 13, 435 (1972); B. Krebs and V. Paulat, Angew. Chem. (Internat. Ed.), 12, 666 (1973); and I. R. Beattie and H. Chudzynska, J. Chem. Soc. (A), 984 (1967), and in Tellurium, W. C. Cooper, editor, Van Nostrand Reinhold Co., N.Y., N.Y., 1971, pages 135–148. Other tellurium (IV) coordination complexes include those represented by the formula: $TeX_4 \cdot 2L$, wherein X is chlorine, bromine or iodine, and L is a neutral ligand with a group Va or VIa donor atom. An example of such a complex is $TeCl_4 \cdot 2(C_6H_5N(CH_3)_2)$; $TeCL_2 \cdot 2$ pyridine; $TeCl_4(RC_6H_4CH{=}NC_6H_5R')_a$ wherein $a$ is 1 or 2, R and R′ are individually hydrogen, para-chlorine, para-bromine or para-$NO_2$; $TeX_4 \cdot 2$ tetramethylthiourea, wherein X is chlorine or bromine; $TeCl_4 \cdot SR_2$ wherein R is a substituent group; and $TeCl_4 \cdot 2$(2,6-lutidine-N-oxide).

Other useful tellurium (IV) compounds are tellurium (IV) coordination complexes with bidentate anionic ligands having group Va and VIa donor atoms, such as $Te(S_2CNR_2)_4$, wherein R is hydrogen, alkyl or aryl, as described. Examples of such compounds are described, for instance, in S. Husebye and S. E. Svaernen, Acta Chem. Scand., 29A, 185 (1975): $Te(O_2C_4H_6)_2$ and P. J. Antikainen and P. J. Malkonen, Z. anorg. u allgem. Chem., 299, 292 (1959).

Further useful tellurium oxidizing agents in imaging elements according to the invention include such tellurium (II) and (IV) derivatives as (1) TeRR′ and (2) RTeTeR wherein R and R′ are individually alkyl, aryl or acyl, as described; as well as, (3) $TeR_nX_{4-n}$, wherein R is alkyl, aryl or acyl, as described, and X is Cl, Br, I, SCN, SeCN, CNO, $N_3$, $BH_3CN$, $O_2CR$ and the like, and $n$ is 1 to 4.

The selection of an optimum tellurium compound or combination of compounds, as described, in an imaging element according to the invention will depend upon such factors as the particular reducing agent in the imaging material, processing conditions, desired image, and the like.

Other useful tellurium (II) and (IV) compounds are included, for instance, in K. J. Irgolic, *The Organic Chemistry of Tellurium*, Gordon and Breach Science Publishers, N.Y., N.Y., 1974 and K. J. Irgolic, J. Organometal. Chem., 103, 91 (1975).

If desired, the described tellurium (II) and (IV) compounds can be prepared in situ in the heat developable photographic materials according to the invention. However, due to better control achieved by preparation of the tellurium compound separate from other components of the described heat developable materials, it is usually desirable to prepare the tellurium (II) and (IV) compounds ex situ, that is, separate from other components of the described compositions. The tellurium compounds then can be mixed with other components of the heat developable photographic materials as desired.

The optimum concentration of the described tellurium compound will depend upon such factors as the particular metal carbonyl compound, the particular reducing agent, the desired image, processing conditions, and the like. An especially useful concentration is typically within the range of about 0.05 mmole/ft$^2$ to about 10 mmoles/ft$^2$. For instance, a heat developable photographic element, as described, can comprise for each mole of the described photosensitive transition metal carbonyl compound, 0.1 to 1000 moles of the described tellurium (II) or (IV) compound and 0.1 to 4000 moles of the described reducing agent.

The described heat developable materials according to the invention need not contain other heavy metal salt oxidizing agents than the described tellurium oxidizing agents. If desired, however, a concentration of a silver salt oxidizing agent, such as a silver salt of a long-chain fatty acid, can be present with the described tellurium compound. Such silver salt oxidizing agents are typically resistant to darkening upon illumination. Typically useful silver salts of long-chain fatty acids are those containing about 17 to 30 carbon atoms. Compounds which can be useful include, for instance: silver behenate, silver stearate, silver oleate, silver laurate, silver hydroxystearate, siler caprate, silver myristate, and silver palmitate. Silver salt oxidizing agents which are not silver salts of long-chain fatty acids can be useful in combination with the described tellurium compounds also. Such silver salt oxidizing agents include, for example, silver benzotriazole, silver benzoate, silver terephthalate, silver imidazole complexes and the like. Examples of other heavy metal salt oxidizing agents which can be useful with the tellurium compounds are gold stearate, mercury behenate and gold behenate. Combinations of the described oxidizing agents can also be useful but are not required.

The described heat developable photographic materials according to the invention can comprise a variety of reducing agents. These reducing agents can be organic reducing agents and inorganic reducing agents. Combinations of organic reducing agents are especially useful. These are typically compounds that have been found useful as silver halide developing agents. Examples of useful reducing agents include polyhydroxybenzenes, such as hydroquinone, alkyl-substituted hydroquinones, including tertiary butyl hydroquinone, methyl hydroquinone, 2,5-dimethylhydroquinone and 2,6-dimethylhydroquinone; catechols and pyrogallols; chloro-substituted hydroquinones such as chlorohydroquinone or dichlorohydroquinone; alkoxy-substituted hydroquinones such as methoxyhydroquinone or ethoxyhydroquinone; aminophenol reducing agents such as 2,4-diaminophenols and methylaminophenols, ascorbic acid reducing agents such as ascorbic acid, ascorbic acid ketals and ascorbic acid derivatives; hydroxylamine reducing agents; 3-pyrazolidone reducing agents such as 1-phenyl-3-pyrazolidone and 4-methyl-4-hydroxymethyl-1-phenyl-3-pyrazolidone; reductone reducing agents, such as 2-hydroxy-5-methyl-3-piperidino-2-cyclopentanone; sulfonamidophenol reducing agents such as para-benzenesulfonamidophenol. Combinations of reducing agents can be useful if desired. Selection of an optimum reducing agent or reducing agent combination will depend upon such factors as the particular metal carbonyl compound, the particular tellurium compound oxidizing agent, desired image, processing conditions and the like.

An optimum concentration of reducing agent or reducing agent combination will depend upon the described factors, such as desired image, particular organotellurium compound, processing conditions, particular transition metal carbonyl compound and the like. A useful concentration of reducing agent or reducing agent combination is typically within the range of about 0.1 to about 100 moles of reducing agent per mole of the described oxidizing agent, preferably a concentration within the range of about 0.5 to about 10 moles of reducing agent per mole of the described oxidizing agent. A typical concentration of the described reducing agent or reducing agent combination in a heat developable photographic element is within the range of about 0.1 to about 1,000 milligrams per square foot of support corresponding to about 0.01 to about 100 milligrams of reducing agent per square decimeter of support. An especially useful concentration of the described reducing agent or reducing agent combination is, in a heat developable photographic element as described, about 1 to about 500 milligrams per square foot which corresponds to about 0.1 to about 50 milligrams per square decimeter of support.

It is desirable in some cases to employ a stabilizer or stabilizer precursor in the described heat developable materials according to the invention to improve post-processing image stability. In some cases the tellurium compounds and other components themselves are stable after processing to provide sufficient post-processing image stability.

The described heat developable photographic materials according to the invention can comprise a variety of colloids and polymers, alone or in combination, as vehicles, binding agents and in various layers. Suitable materials can be hydrophobic or hydrophilic. They are transparent or translucent and include both naturally occurring substances such as proteins, for example, gelatin, gelatin derivatives, cellulose derivatives, polysaccharides, such as dextran, gum arabic and the like; and synthetic polymeric substances such as water-soluble polyvinyl compounds like poly(vinyl pyrrolidone), acrylamide polymers and the like. Other synthetic polymeric compounds which can be useful include dispersed vinyl compounds, such as in latex form, and particularly those which increase dimensional stability of photographic materials. Effective polymers include water-insoluble polymers of alkyl acrylates and methacrylates, acrylic acid, sulfoalkyl acrylates, methacrylates, and those which have crosslinking sites which facilate hardening or curing. Especially useful materials are high molecular weight materials and resins which can withstand the processing temperatures that are most useful and which are compatible with the described tellurium compounds, including poly(vinyl butyral), cellulose acetate butyrate, poly(methylmethacrylate), poly(vinyl pyrrolidone), ethyl cellulose, polystyrene, poly(vinyl chloride), polyisobutylene, butadienestyrene copolymers, vinyl chloride-vinyl acetate copolymers, copolymers of vinyl acetate, vinyl chloride and maleic acid, and poly(vinyl alcohol). Combinations of the described colloids and polymers can also be useful.

An optimum concentration of a binder or combination of binders in the described photographic materials will depend upon such factors as the components in the material, the desired image, processing conditions and the like.

It is useful in many cases to provide an overcoat layer on the heat developable, photographic element according to the invention to reduce fingerprinting and abrasion mark susceptibility of the element. The overcoat layer can be one or more of the described polymers which are also useful as binders or other polymeric materials which are compatible with the heat developable layer of the described element and can tolerate the processing temperatures employed according to the invention.

The heat developable materials according to the invention can contain development modifiers that function as speed-increasing compounds, hardeners, antistatic layers, plasticizers and lubricants, coating aids, brighteners, spectral sensitizing dyes, absorbing and filter dyes, also as described in the *Product Licensing Index,* Volume 92, December 1971, publication 9232, pages 107–110, published by Industrial Opportunities Ltd., Homewell, Havant Hampshire, P09 1EF, UK.

The heat developable elements according to the invention can comprise a variety of supports which can tolerate the processing temperatures that are useful according to the invention. Typical supports include poly(vinyl acetal) film, poly(ethylene terephthalate) film, polycarbonate film and polyester film supports, such as described in U.S. Pat. No. 3,634,089 of Hamb, issued Jan. 11, 1972 and U.S. Pat. No. 3,725,070 of Hamb et al, issued Apr. 3, 1973 and related films and resinous materials, as well as glass, paper, metal and the like supports which can withstand the processing temperatures employed according to the invention. Typically, a flexible support is employed.

The compositions according to the invention can be coated on a suitable support by various coating procedures known in the photographic art including dip coating, air-knife coating, curtain coating or extrusion coating using hoppers such as described in U.S. Pat. No. 2,681,294 of Beguin, issued June 15, 1954. If desired, two or more layers can be coated simultaneously such as described in U.S. Pat. No. 2,761,791 of Russell, issued Sept. 4, 1956 and British Pat. No. 837,095.

The described components of the heat developable materials according to the invention can be in any suitable location in the heat developable element as described which provides the desired image. If desired, one or more components of the heat developable element according to the invention can be in one or more layers of the element. For example, in some cases, it can be desirable to include certain concentrations of the described reducing agents or other addenda in a protective layer over the heat developable element. In some cases this can reduce migration of certain addenda between layers of the described element.

It is believed that upon imagewise exposure of the described element that nuclei are formed which can increase the reaction rate of the described oxidation-reduction image-forming combination to provide the desired image upon heating of the element. It is believed that this enables a lower processing temperature for amplification than otherwise would be possible.

The term "in reactive association" as used herein is intended to mean that the nuclei resulting from imagewise exposure are in a location with respect to the other described components, especially the described oxidation-reduction image-forming combination, of the material according to the invention which enables this desired lower processing temperature and provides a more useful developed image. The compounds can be, for example, in the same layer or in contiguous layers. The nuclei, for instance, can be in one layer and the described oxidation-reduction image-forming combination can be in a separate contiguous layer of an element as described.

If desired, other heat developable, photographic materials can be useful in combination with the heat developable photographic materials according to the invention containing the described photosensitive transition metal carbonyl compound. For example, the heat developable, photographic element can comprise, in sequence, a support having thereon a heat developable photographic layer comprising a photosensitive transition metal carbonyl compound with an oxidation-reduction image-forming combination comprising an organotellurium compound, also as described, and a separate layer containing a photoethermographic material containing a different photosensitive component with other necessary imaging materials.

A variety of organotellurium compound oxidizing agents and photosensitive transition metal carbonyl compounds with a variety of reducing agents are useful in heat developable materials according to the invention. But, an especially useful heat developable photographic material is a heat developable photographic material comprising, in reactive association, (a) photosensitive arene chromiumtricarbonyl, as described, with (b) an oxidation-reduction image-forming combination comprising (i) a tellurium complex consisting essentially of $Te(S_2CN(C_2H_5)_2)_2$, with (ii) a 3-pyrazolidone developing agent, and (c) a synthetic polymeric binder. Another especially useful heat developable photographic material according to the invention comprises, in reactive association, (a) a photosensitive arene chromiumtricarbonyl, as described, with (b) an oxidation-reduction image-forming combination comprising (i) an organotellurium compound as an oxidizing agent consisting essentially of $Te(S_2CN(C_2H_5)_2)_2$ with (ii) a benzenesulfonamidophenol reducing agent, and (c) a synthetic polymeric binder.

Synthetic polymeric binders which can be especially useful in the described embodiments can be selected from the group consisting of (A) poly(methyl acrylate-co-vinylidene chloride-co-itaconic acid), (B) poly(methyl acrylate-co-acrylonitrile-co-vinylidene chloride-co-acrylic acid), (C) poly(acrylonitrile-co-vinylidene chloride), (D) poly(vinyl acetate-co-vinyl alcohol-co-vinyl acetal), (E) poly(vinyl butyral), and (F) polycarbonate binders.

Various imagewise exposure means are useful with the photosensitive materials according to the invention. The photosensitive materials according to the invention are typically sensitive to the ultraviolet and blue regions of the spectrum and exposure means which provide this radiation are preferred. Typically, a photosensitive element according to the invention is exposed imagewise with a visible light source such as a tungsten lamp, athough other sources of radiation are useful such as lasers, electron beams and the like. The intensity of the imagewise exposure is typically sufficient to provide a developable latent image.

A visible image can be developed in a heat developable, photographic material, as described, after imagewise exposure, within a short time merely by overall heating the heat developable photographic material. An image having a maximum reflection density of at least 1.0 and typically at least 1.5 can be provided according to the invention. For example, the heat developable photographic element can be heated to a temperature within the range of about 80° to about 250° C until a desired image is developed, typically within about 1 to about 90 seconds. The heat developable photographic material according to the invention is preferably heated to a temperature within the range of about 100° to about 180° C until the desired image is developed.

A useful embodiment of the invention is a process of developing a latent image in an exposed heat developable photographic element as described comprising heating the element to a temperature within the range of about 100° to about 180° C for about 1 to about 10 seconds until the desired image is developed.

A heat developable photographic material according to the invention can be useful for forming a negative or positive image. The formation of a negative or positive image will depend primarily upon such factors as the particular transition metal carbonyl compound, the particular tellurium compound and the particular reducing agent.

Development of an image can also be carried out using a diffusion transfer process. In one embodiment of such a process, a photographic element comprising a photosensitive, transition metal carbonyl compound as described is exposed imagewise to provide a developable image and is then contacted with a receiving sheet comprising an oxidation-reduction image-forming combination according to the invention. When the element and the receiving sheet are in contact, heat is applied to promote diffusion of unexposed photosensitive, transition metal carbonyl compound from the element to the receiver sheet. Contact temperatures within the range of about 45° to about 200° C are useful. In the unexposed areas of the element, the photosensitive transition metal carbonyl compound migrates from the element to the receiving sheet in which it is reduced and catalyzes the reduction of the organotellurium compound to tellurium metal by the reducing agent in the sheet to form an image in the receiving sheet.

In another embodiment of a diffusion transfer process, the described photographic element comprises at least one photographic layer having permanently associated therewith a receiving layer. The photographic layer comprises a photosensitive, transition metal carbonyl compound and the receiving layer comprises an organotellurium compound with a reducing agent in an oxidation-reduction image-forming combination according to the invention. The element is exposed to provide a developable latent image and is then heated to a temperature within the range of about 75° to about 250° C to promote diffusion of unexposed photosensitive, transition metal carbonyl compound to the receiving layer. In the unexposed areas of the photographic layer, the photosensitive, transition metal carbonyl compound diffuses from the layer to the receiving layer where it is reduced and acts as a catalyst as described above to form a desired image in the receiving layer.

The following examples are included for a further understanding of the invention.

EXAMPLE 1

Benzenechromiumtricarbonyl with $Te(S_2CN(C_2H_5)_2)_2$

A tellurium compound having the formula $Te(S_2CN(C_2H_5)_2)_2$ (100 milligrams) and 1-phenyl-3-pyrazolidone (100 milligrams) were dissolved in 9 milliliters of a 5% by weight solution of poly(vinyl butyral) (Butvar B-76 available from the Monsanto Company, U.S.A.) in an organic solvent which consisted of $CH_2Cl_2$ with $C_2H_3Cl_3$ (7:3 parts by volume). To this solution was added 1 milliliter of a solution of 100 milligrams of benzenechromiumtricarbonyl in 10 milliliters of $CH_2Cl_2$. The resulting solution was coated at a 10 mil wet coating thickness on a poly(ethylene terephthalate) film support and permitted to dry. The resulting heat developable photograhic element was then cut into strips which were imagewise exposed to provide a developable image in each strip. The imagewise exposure was provided by one flash of a high intensity light source (an Ascorlight 660 unit, available from the Berkey Technical Corp., U.S.A.) After imagewise exposure, the strips were heat processed by contacting the strips with a heated metal block at 160° C for 10 seconds to provide a developed, black, negative image in each strip.

The procedure was repeated with the exception that the exposed film strips were processed by contacting them with a heated metal block at 180° C. No fog was observed in the non-image areas of the developed materials.

EXAMPLE 2

Use of polystyrene binder and polysiloxane surfactant

A solution was prepared by mixing the following components:

| | | |
|---|---|---|
| benzenechromiumtricarbonyl | 50 | mg |
| $Te(S_2CN(C_2H_5)_2)_2$ | 100 | mg |
| 1-phenyl-3-pyrazolidone (reducing agent) | 100 | mg |
| polystyrene (binder) (Koppers 8X, which is a trade name of and available from the Koppers Company, U.S.A.) | 1000 | mg |
| surfactant (SF-1066 which is a non-ionic copolymer of a dimethylpolysiloxane and polyoxyalkylene ether available from the General Electric Company, U.S.A.) (2% by weight solution in dichloromethane) | 0.2 | ml |

All of the above components were dissolved in 10 milliliters of dichloromethane with 1,1,2-trichloroethane (7:3 parts by volume) as a solvent mixture.

The resulting composition was coated at a 6 mil wet coating thickness on a poly(ethylene terephthalate) film support containing a subbing layer of poly(methyl acrylate-co-vinylidene chloride-co-itaconic acid). The resulting coating was permitted to dry at 50° C.

The resulting heat developable, photographic film was imagewise exposed to a light source for 120 seconds through a silver step tablet to provide a developable latent image. (The light source was GE-F8T5-DL tube available from the General Electric Company, U.S.A.). The exposed, heat developable, photograhic element was heat processed by contacting the film with a heated metal block at 140° C for 30 seconds to provide a developed, black, tellurium image. The maximum density of the image was about 2.5 with a minimum density of about 0.1.

EXAMPLES 3–12

Use of a variety of arene chromiumtricarbonyls

The procedure described in Example 2 was repeated with the exception that the arene chromiumtricarbonyls described in the following Table I were used in place of benzene chromiumtricarbonyl.

Table I

| Ex. No. | Arene Chromium Tricarbonyl | Amount(mg) added to 10 ml of solvent |
|---|---|---|
| 3 | Toluene $Cr(CO)_3$ | 53 |
| 4 | p-Xylene $Cr(CO)_3$ | 57 |
| 5 | Mesitylene $Cr(CO)_3$ | 150 |
| 6 | Methyl benzoate $Cr(CO)_3$ | 63 |
| 7 | Tetralin $Cr(CO)_3$ | 62 |
| 8 | Anisole $Cr(CO)_3$ | 56 |

Table I-continued

| Ex. No. | Arene Chromium Tricarbonyl | Amount(mg) added to 10 ml of solvent |
|---|---|---|
| 9 | Aniline $Cr(CO)_3$ | 54 |
| 10 | N,N-Dimethylaniline $Cr(CO)_3$ | 60 |
| 11 | p-Toluidine $Cr(CO)_3$ | 57 |
| 12 | Michler's ketone $Cr(CO)_3$ | 150 |

A sample of each of the described heat developable photograhic elements was imagewise exposed for 120 seconds as described in Example 2. The resulting latent image was developed by contacting the film in each instance with a metal block at 140° C for 30 seconds. In each instance a negative, black, tellurium image was developed. The maximum density in each case was within the range of 2.2 to 3.0 with a minimum density within the range of 0.1 to 0.3.

EXAMPLES 13–19

Use of a variety of polymeric binders

The procedure described in Example 2 was repeated with the exception that the polymers described in following Table II were used in each instance in place of polystyrene as the binder.

Table II

| Ex. No. | Binder | Amount (mg) added to 10 ml of solvent |
|---|---|---|
| 13 | Lexan-145 (polycarbonate)** | 1000 |
| 14 | Poly[4,4'-(2-norbornylidene)diphenylene carbonate] | 1000 |
| 15 | Formvar 12/85 (poly(vinyl acetate-co-vinyl alcohol-co-vinyl acetate))*** | 1000 |
| 16 | Cellulose acetate butyrate | 500 |
| 17 | Saran F-300 (poly(acrylonitrile-co-vinylidene chloride))**** | 1000 |
| 18 | Poly(methyl acrylate-co-acrylonitrile-co-vinylidene chloride-co-acrylic acid) | 1000 |
| 19 | Poly(methyl acrylate-co-vinylidene chloride-co-itaconic acid) | 1000 |

**trade name of and available from General Electric Company, U.S.A.
***trade name of and available from Monsanto Chemical Co., U.S.A.
****trade name of and available from Dow Chemical Co., U.S.A.

Samples of each of the heat developable, photographic films were imagewise exposed as described in Example 2 to provide a developable latent image in the element. The resulting image was developed by contacting the imagewise exposed film with a heated metal block at 140° C for 30 seconds as described in Example 3 to provide a developed, negative, black tellurium image in each instance. The maximum developed density in each case was within the range of 2.2 to 3.0 with a minimum density within the range of 0.1 to 0.3.

EXAMPLES 20–22

A solution was prepared by mixing the following components:

| | |
|---|---|
| metal carbonyl (as listed in following Table III) | |
| $Te(S_2CN(C_2H_5)_2)_2$ | 150 mg |
| 1-phenyl-3-pyrazolidone | 150 mg |
| poly(methyl acrylate-co-vinylidene chloride-co-itaconic acid) | 750 mg |
| surfactant (surfactant SF-1066 as described) (2% by weight solution in dichloromethane) | 0.2 ml |

All of the above components were dissolved in 10 ml of a solvent mixture consisting of dichloromethane with 1,1,2-trichloroethane (7:3). The resulting composition was coated at a 4 mil wet coating thickness at 27° C on a poly(ethylene terephthalate) film support having a subcoating of poly(methyl acrylate-co-vinylidene chloride-co-itaconic acid). The resulting layer was permitted to dry for 5 minutes at 50° C. The resulting heat developable, photograhic element was then imagewise exposed to provide a developable latent image as described in Example 2 and then heated to develop the resulting image, also as described in Example 2. A developed image resulted in each instance which was a negative, black, tellurium image.

Table III

| Ex. No. | Metal Carbonyl | Amount(mg) added to 10 ml of solvent |
|---|---|---|
| 20 | Acetonitrile $Cr(CO)_5$ | 53 |
| 21 | Cyclopentadiene $Mo(CO)_4CH_3$ | 91 |
| 22 | Cyclopentadiene $Fe(CO)_2I$ | 143 |

EXAMPLE 23

Te(IV) coordination complex as an oxidizing agent

The following components were mixed:

| | |
|---|---|
| benzene chromiumtricarbonyl | 100 mg |
| $Te(S_2CN(C_2H_5)_2)_4$ | 255 mg |
| 1-phenyl-3-pyrazolidone | 100 mg |
| poly(methyl acrylate-co-vinylidene chloride-co-itaconic acid) | 750 mg |
| surfactant (surfactant SF-1066 as described) (2% by weight solution in dichloromethane) | 0.2 ml |

All of the above components were dissolved in 10 ml of a solvent mixture consisting of dichloromethane with 1,1,2-trichloromethane (7:3).

The resulting composition was coated at a 4 mil wet coating thickness at 27° C on a poly(ethylene terephthalate) film support having a subbing layer of poly(methyl acrylate-co-vinylidene chloride-co-itaconic acid). The resulting layer was permitted to dry for 5 minutes at 50° C. Then the resulting heat developable photograhic element was imagewise exposed to provide a latent image as described in Example 3. The exposed element was then heated as described in Example 3 to provide a developed, negative, black tellurium image in the element.

EXAMPLES 24–27

Use of various reducing agents

The following solution was prepared by mixing the following components:

| | |
|---|---|
| tetralin chromium tricarbonyl | 128 mg |
| $Te(S_2CN(C_2H_5)_2)_4$ | 150 mg |
| reducing agent (as listed in following Table IV) | |
| poly(methyl acrylate-co-vinylidene chloride-co-itaconic acid) | 750 mg |
| surfactant (surfactant SF-1066 as described) (2% by weight solution in dichloromethane) | 2.0 ml |

All of the above were dissolved in a solvent mixture consisting of 10 ml of dichloromethane with 1,1,2-trichloroethane (7:3).

The resulting composition was coated on a poly(ethylene terephthalate) film support at a 4 mil wet coating thickness at 27° C. The poly(ethylene terephthalate) film support had a subbing layer of poly(methyl acrylate-co-vinylidene chloride-co-itaconic acid). The resulting heat developable, photographic element was imagewise exposed as described in Example 2 to provide a developable latent image in the element. The image was developed by heating the element as described in Example 3 to provide a developed, negative, black tellurium image.

Table IV

| Ex. No. | Developer | Amount(mg) added to 10 ml of solvent |
|---|---|---|
| 24 | 2,6-Dichlorobenzene-sulfonamidophenol | 284 |
| 25 | tert-butylhydroquinone | 153 |
| 26 | Pyrogallol | 117 |
| 27 | Gallic Acid | 157 |

An advantage of many of the described heat developable imaging materials of the invention is that they can provide a high density developed image, that is, a developed image having a maximum density of at least 3. The resolution of the resulting materials is also high, that is the resolution is at least 1,000 lines per millimeter.

In most cases the developed image is stable after processing. For most purposes no post-processing image stabilizer or stabilizer precursor is required.

Positive working heat developable photographic materials are also useful according to the invention as illustrated in the following examples.

EXAMPLE 28

Positive-working element

A solution of (phenyl)$_3$ PbTe-$C_6H_4$-$CH_3$-p (100 mg), dimethylamine borane (100 mg) and benzene chromiumtricarbonyl (50 mg) in 10 ml of a 5% by weight solution of poly(vinyl butyral) (Butvar B-76 which is a trade name of and available from Monsanto Chemical Company, U.S.A.) in a solvent mixture of methylene chloride with 1,1,1-trichloroethane (7:3) was coated on a poly(ethylene terephthalate) film support at a wet coating thickness of 9 mils. The resulting coating was permitted to dry to provide a heat developable, photographic element according to the invention.

Strips of the resulting heat developable, photographic film were imagewise exposed to a high intensity electronic light flash source to provide a developable image in the film. (Ascorlight 660 electron flash unit available from Berkey Technical Corporation, U.S.A.). The resulting image was developed by contacting the element after exposure with a heated block at 150° C for 5 seconds to provide a developed, dark brown, positive image. The background areas of the film contained no observable fog.

EXAMPLE 29

Positive-working element

A solution of dibenzyltellurium iodide (100 mg) and aniline chromiumtricarbonyl (60 mg) in 10 ml of a 5% solution of poly(vinyl butyral) (Butvar B-76 as described) in a solvent mixture of methylene chloride with 1,1,1-trichloroethane (7:3) was coated on a poly(ethylene terephthalate) film support at a wet coating thickness of 9 mils. The resulting coating was permitted to dry to provide a heat developable, photographic element according to the invention. The element was then imagewise exposed to provide a developable latent image in the element. The imagewise exposure consisted of five flashes from an electronic high intensity flash unit (Ascorlight 660 as described). The resulting image was developed by contacting the element with a heated metal block at 140° C for 10 seconds. A dark brown, positive image was developed with tan fog in the background.

A similar coating was prepared with the exception that 100 mg of one of the following reducing agents was also added to the described coating solution:

(a) benzenesulfonamidophenol,
(b) 2,6-dichlorobenzenesulfonamidophenol and
(c) 2,5-di-tertiary butyl hydroquinone.

In each instance after imagewise exposure and processing as described above, a positive developed image was produced.

EXAMPLE 30

Positive-working element

A solution of [(benzyl)$_3$Sn]$_2$Te (100 mg), 1-phenyl-3-pyrazolidone (100 mg), and $((C_6H_4)_3P)_2NCo(CO)_4$ (10 mg) in 10 ml of a 5% by weight solution of poly(vinyl butyral) (Butvar B-76 as described) in a solvent mixture of methylene chloride with 1,1,1-trichloroethane (7:3) was coated on a poly(ethylene terephthalate) film support at a wet coating thickness of 10 mils. The resulting coating was permitted to dry and then separated into strips which were imagewise exposed to provide a developable latent image in the strips. The imagewise exposure consisted of five flashes from a high intensity flash unit. (Ascorlight 660 as described). The resulting strips were then heated by contacting them with a metal block at 120° C for 10 seconds to provide a developed dark gray positive image in each case with tan fog in the background areas.

The invention has been described in detail with particular reference to preferred embodiments thereof, but it will be understood that variations and modifications can be effected within the spirit and scope of the invention.

What is claimed is:

1. A heat developable, photographic element comprising a support having thereon, in reactive association, (a) a photosensitive, transition metal carbonyl compound, wherein said transition metal is selected from transition elements in groups Vb, VIb, VIIb and VIII of the Periodic Table
(b) an oxidation-reduction image-forming combination comprising:
  (i) an organotellurium (II) or (IV) compound as an oxidizing agent, with
  (ii) a reducing agent, and
(c) a binder.

2. A heat developable, photographic element as in claim 1 wherein said photosensitive, transition metal carbonyl compound is represented by the formula:

$$RM(CO)_nX_m$$

wherein R is an arene, a substituted arene, a cyclopentadienyl ligand or an acetonitrile ligand; M is Cr, Mo or Fe; X is alkyl, chlorine, bromine or iodine; $n$ is 3 to 5; and, $m$ is 0 or 1.

3. A heat developable, photographic element as in claim 1 wherein said photosensitive, transition metal carbonyl compound is an arene chromiumtricarbonyl compound.

4. A heat developable, photographic element as in claim 1 wherein said photosensitive, transition metal carbonyl compound consists essentially of tetralin chromiumtricarbonyl or mesitylene chromiumtricarbonyl.

5. A heat developable, photographic element as in claim 1 wherein said organotellurium compound is a coordination complex of tellurium (II).

6. A heat developable, photographic element as in claim 1 wherein said organotellurium compound is a coordination complex of tellurium (II) with two univalent bidentate sulfur-containing compounds.

7. A heat developable, photographic element as in claim 1 wherein said organotellurium compound is a compound selected from the group consisting of
$Te(S_2CN(C_2H_5)_2)_2$,
$Te(S_2CN(C_2H_5)_2)_4$,
$Te[S_2CN(C_6H_5)_2]_2$, and
$Te(S_2COC_{12}H_{25})_2$.

8. A heat developable, photographic element as in claim 1 wherein said reducing agent is selected from the group consisting of 3-pyrazolidone and phenolic developing agents.

9. A heat developable, photographic element as in claim 1 wherein said reducing agent is a benzenesulfonamidophenol developing agent.

10. A heat developable, photographic element as in claim 1 wherein said reducing agent consists essentially of 2,6-dichlorobenzenesulfonamidophenol.

11. A heat developable, photographic element as in claim 1 wherein said binder is a synthetic polymeric binder.

12. A heat developable, photographic element as in claim 1 wherein said binder is a synthetic polymeric binder selected from the group consisting of
(A) poly(methyl acrylate-co-vinylidene chloride-co-itaconic acid),
(B) poly(methyl acrylate-co-acrylonitrile-co-vinylidene chloride-co-acrylic acid),
(C) poly(acrylonitrile-co-vinylidene chloride),
(D) poly(vinyl acetate-co-vinyl alcohol-co-vinyl acetal),
(E) poly(vinyl butyral), and
(F) polycarbonate binders.

13. A heat developable, photographic element as in claim 1 comprising for each mole of said photosensitive, transition metal carbonyl compound, 0.1 to $10^3$ moles of said organotellurium compound and 0.1 to $4 \times 10^3$ moles of said reducing agent.

14. A heat developable, photographic element comprising a support having thereon, in reactive association,
(a) a photosensitive arene chromiumtricarbonyl,
(b) an oxidation-reduction image-forming combination comprising
(i) a tellurium complex consisting essentially of $Te(S_2CN(C_2H_5)_2)_2$, with
(ii) a 3-pyrazolidone developing agent, and
(c) a synthetic polymeric binder.

15. A heat developable, photographic element comprising a support having thereon, in reactive association,
(a) a photosensitive arene chromiumtricarbonyl,
(b) an oxidation-reduction image-forming combination comprising
(i) an organotellurium compound as an oxidizing agent consisting essentially of $Te(S_2CN(C_2H_5)_2)_2$, with
(ii) a benzenesulfonamidophenol reducing agent, and
(c) a synthetic polymeric binder.

16. A heat developable, photographic composition comprising
(a) a photosensitive, transition metal carbonyl compound, wherein said transition metal in selected from transition elements in groups Vb, VIb, VIIb and VIII of the Periodic Table
(b) an oxidation-reduction image-forming combination comprising:
(i) an organotellurium (II) or (IV) compound as an oxidizing agent, with
(ii) a reducing agent, and
(c) a binder.

17. A heat developable, photographic composition as in claim 16 wherein said photosensitive, transition metal carbonyl compound is represented by the formula:

$$RM(CO)_nX_m$$

wherein R is an arene, a substituted arene, a cyclopentadienyl ligand or an acetonitrile ligand; M is Cr, Mo or Fe; X is alkyl, chlorine, bromine or iodine; $n$ is 3 to 5; and, $m$ is 0 or 1.

18. A heat developable, photographic composition as in claim 16 wherein said photosensitive, transition metal carbonyl compound is an arene chromiumtricarbonyl compound.

19. A heat developable, photographic composition as in claim 16 wherein said photosensitive, transition metal carbonyl compound consists essentially of tetralin chromiumtricarbonyl, benzene chromiumtricarbonyl or mesitylene chromiumtricarbonyl.

20. A heat developable, photographic composition as in claim 16 wherein said organotellurium compound is a coordination complex of tellurium (II).

21. A heat developable, photographic composition as in claim 16 wherein said organotellurium compound is a coordination complex of tellurium (II) with two univalent bidentate sulfur-containing compounds.

22. A heat developable, photographic composition as in claim 16 wherein said organotellurium compound is a complex selected from the group consisting of
$Te(S_2CN(C_2H_5)_2)_2$,
$Te(S_2CN(C_2H_5)_2)_4$,
$Te[S_2CN(C_6H_5)_2]_2$, and
$Te(S_2COC_{12}H_{25})_2$.

23. A heat developable, photographic composition as in claim 16 wherein said reducing agent is selected from the group consisting of 3-pyrazolidone and phenolic developing agents.

24. A heat developable, photographic composition as in claim 16 wherein said reducing agent is a benzenesulfonamidophenol developing agent.

25. A heat developable, photographic composition as in claim 16 wherein said reducing agent consists essentially of 2,6-dichlorobenzenesulfonamidophenol.

26. A heat developable, photographic composition as in claim 16 wherein said binder is a synthetic polymeric binder.

27. A heat developable, photographic composition as in claim 16 wherein said binder is a synthetic polymeric binder selected from the group consisting of
(A) poly(methyl acrylate-co-vinylidene chloride-co-itaconic acid),
(B) poly(methyl acrylate-co-acrylonitrile-co-vinylidene chloride-co-acrylic acid),
(C) poly(acrylonitrile-co-vinylidene chloride),
(D) poly(vinyl acetate-co-vinyl alcohol-co-vinyl acetal), (E) poly(vinyl butyral), and
(F) polycarbonate binders.

28. A heat developable, photographic composition as in claim 16 comprising for each mole of said photosensitive, transition metal carbonyl compound, 0.1 to $10^3$ moles of said tellurium complex and 0.1 to $4 \times 10^3$ moles of said reducing agent.

29. A heat developable, photographic composition comprising
(a) photosensitive arene chromiumtricarbonyl,
(b) an oxidation-reduction image-forming combination comprising
(i) an organotellurium compound as an oxidizing agent consisting essentially of $Te(S_2CN(C_2H_5)_2)_2$, with
(ii) a 3-pyrazolidone developing agent, and
(c) a synthetic polymeric binder.

30. A heat developable, photographic composition comprising
(a) a photosensitive arene chromiumtricarbonyl,
(b) an oxidation-reduction image-forming combination comprising
(i) an organotellurium compound as an oxidizing agent consisting essentially of $Te(S_2CN(C_2H_5)_2)_2$, with
(ii) a benzenesulfonamidophenol reducing agent, and
(c) a synthetic polymeric binder.

31. A process of developing a latent image in an exposed heat developable, photographic element as defined in claim 1 comprising heating said element to a temperature within the range of about 80° to about 250° C until the latent image is developed.

32. A process of developing a latent image in an exposed heat developable, photographic element as defined in claim 14 comprising heating said element to a temperature of about 80° to about 250° C until the latent image is developed.

33. A process of developing a latent image in an exposed heat developable, photographic element as defined in claim 15 comprising heating said element to a temperature of about 80° to about 250° C until the latent image is developed.

* * * * *

UNITED STATES PATENT AND TRADEMARK OFFICE

CERTIFICATE OF CORRECTION

PATENT NO. : 4,097,281

DATED : June 27, 1978

INVENTOR(S) : Sylvia A. Gardner and Mark Lelental

It is certified that error appears in the above-identified patent and that said Letters Patent are hereby corrected as shown below:

Column 4, line 66, "sustitution" should read ---substitution---.

Column 6, lines 1-2, "compexes" should read ---complexes---; line 18, "$TeCL_2 \cdot 2$" should read ---$TeCl_2 \cdot 2$---.

Column 7, line 21, "siler" should read ---silver---.

Column 8, line 44, "facilate" should read ---facilitate---.

Column 10, line 10, "photoethermographic" should read ---photothermographic---; line 51, "athough" should read ---although---.

Column 11, line 67, "photograhic" should read ---photographic---.

Column 12, line 33, delete "10" before "dichloromethane".

Column 13, line 9, "photograhic" should read ---photographic---.

UNITED STATES PATENT AND TRADEMARK OFFICE

CERTIFICATE OF CORRECTION

PATENT NO. : 4,097,281 Page 2 of 2

DATED : June 27, 1978

INVENTOR(S) : Sylvia A. Gardner and Mark Lelental

It is certified that error appears in the above-identified patent and that said Letters Patent are hereby corrected as shown below:

Column 14, line 4, "photograhic" should read ---photographic---; line 24, the line should read ---$Te(S_2CN(C_2H_5)_2)_4$ 255 mg---; line 53, "$Te(S_2CN(C_2H_5)_2)_4$" should read ---$Te(SCN(C_2H_5)_2)_2$---.

Signed and Sealed this

Ninth Day of January 1979

[SEAL]

Attest:

RUTH C. MASON
Attesting Officer

DONALD W. BANNER
Commissioner of Patents and Trademarks